US011041613B1

(12) United States Patent
Huang et al.

(10) Patent No.: US 11,041,613 B1
(45) Date of Patent: Jun. 22, 2021

(54) CEILING LAMP

(71) Applicant: LONGHORN INTELLIGENT TECH CO., LTD., Guangdong (CN)

(72) Inventors: Xingwei Huang, Guangdong (CN); Bo Lu, Guangdong (CN); Lin Yang, Guangdong (CN); Haitao Yang, Guangdong (CN)

(73) Assignee: LONGHORN INTELLIGENT TECH CO., LTD., Shenzhen (CN)

( * ) Notice: Subject to any disclaimer, the term of this patent is extended or adjusted under 35 U.S.C. 154(b) by 305 days.

(21) Appl. No.: 16/341,443

(22) PCT Filed: Jul. 10, 2018

(86) PCT No.: PCT/CN2018/095168
§ 371 (c)(1),
(2) Date: Apr. 11, 2019

(87) PCT Pub. No.: WO2019/227605
PCT Pub. Date: Dec. 5, 2019

(30) Foreign Application Priority Data

Jun. 1, 2018 (CN) ..... 201820856804.5

(51) Int. Cl.

| | |
|---|---|
| ***F21V 23/00*** | (2015.01) |
| ***F21V 23/06*** | (2006.01) |
| ***F21V 17/06*** | (2006.01) |
| *F21S 8/02* | (2006.01) |

(52) U.S. Cl.
CPC ..... *F21V 23/06* (2013.01); *F21V 17/06* (2013.01); *F21S 8/026* (2013.01)

(58) Field of Classification Search
CPC .. F21V 17/12; F21V 17/16–164; F21V 23/06; F21V 17/06; F21S 8/026
See application file for complete search history.

(56) References Cited

U.S. PATENT DOCUMENTS 6,082,871 A * 7/2000 Yeh ..... F21V 17/02 362/147
9,206,961 B1 12/2015 Bastiani et al.
2002/0044446 A1* 4/2002 Layne ..... F21S 8/06 362/294

(Continued)

FOREIGN PATENT DOCUMENTS

CN 106439641 A 2/2017
CN 107606547 A 1/2018

*Primary Examiner* — Gerald J Sufleta, II

(57) ABSTRACT

A ceiling lamp, including: a lamp body, a mounting plate, a lighting module and a driving power supply electrically connected with the lighting module, the lighting module and the driving power supply are both disposed in the lamp body, the lamp body is detachably fixed to the mounting plate in a screwing manner; the ceiling lamp further includes a screwing assembly configured to detachably fix the lamp body to the mounting plate in a screwing manner, the screwing assembly includes a engagement module disposed on the mounting plate and configured to be electrically connected with the mains electricity, and a snap-fit module disposed at the lamp body and configured to be electrically connected with the driving power supply, the snap-fit module is connected with the engagement module in a screwing manner to form an electrical connection.

14 Claims, 9 Drawing Sheets

(56) References Cited

U.S. PATENT DOCUMENTS

| | | | | |
|---|---|---|---|---|
| 2011/0141730 | A1* | 6/2011 | Lee | F21V 19/0025<br>362/235 |
| 2011/0175533 | A1* | 7/2011 | Holman | E04B 9/32<br>315/130 |
| 2013/0083529 | A1* | 4/2013 | Gifford | F21V 21/03<br>362/249.02 |
| 2014/0301076 | A1* | 10/2014 | Ter-Hovhannisyan | F21K 9/20<br>362/235 |
| 2017/0082253 | A1* | 3/2017 | Sorensen | F21V 21/34 |
| 2018/0010779 | A1* | 1/2018 | Zhou | F21V 19/0055 |
| 2018/0172254 | A1* | 6/2018 | Liang | F21V 21/02 |
| 2018/0216801 | A1* | 8/2018 | Thiele | F21V 19/004 |
| 2018/0279428 | A1* | 9/2018 | Deng | F21V 3/00 |
| 2018/0356057 | A1* | 12/2018 | Xu | F21S 8/04 |
| 2019/0293276 | A1* | 9/2019 | Pearson | F21V 21/14 |
| 2020/0018469 | A1* | 1/2020 | Kohen | G08B 13/196 |

* cited by examiner

A-A

CEILING LAMP

CROSS-REFERENCE TO RELATED APPLICATION

This application is the International Application No. PCT/CN2018/095168 for entry into US national phase, with an international filing date of Jul. 10, 2018 designating the U.S., now pending, and claims priority benefits to Chinese Patent Application No. 201820856804.5, filed on Jun. 1, 2018, the contents of which being incorporated herein by reference.

TECHNICAL FIELD

The present application relates to the technical field of lighting, and more particularly to a ceiling lamp.

BACKGROUND

At present, the ceiling lamps in the current market are mainly classified according to the installation methods thereof mainly as the following two:

1. A structure consists of a full-gloss plastic cover and a metal base, the structure is generally provided with a plastic hook or a metal clamping point on the metal base, when installing, the metal base is first screwed to the ceiling, and then the lamp cover is connected to the plastic hook or the metal clamping point on the metal base in a screwing manner. However, using this way, since the lamp cover is separated from the base during installation, the installation of a user is inconvenient, and the installation by the user cannot be ensured that the lamp cover can be mounted in place, and it is easy to enter dust or mosquitoes, thereby affecting the light-emitting effect.

2. It consists of a lamp body and a mounting plate, and the lamp body is provided with a spring clip for connected with the mounting plate; in this way, only the artificial shaking can be used to initially determine the effect of the installation, and it is impossible to accurately confirm whether the installation is in place, and it is a risk of improper installation and misassembly.

SUMMARY

An object of the present application is to provide a ceiling lamp, in order to solve the technical problem that the existing ceiling lamp is easy to enter dust or mosquitoes, the installation by user is inconvenient, and it is impossible to directly confirm whether the installation of the lamp body is in place and resulting in risk of improper installation.

In order to achieve above object, the technical solution adopt in the present application is provided a ceiling lamp, including: a lamp body, a mounting plate, a lighting module and a driving power supply electrically connected with the lighting module, the lighting module and the driving power supply are both disposed in the lamp body, the lamp body is detachably screwed to the mounting plate; the ceiling lamp further comprises a screwing assembly configured to detachably fix the lamp body to the mounting plate in a screwing manner, the screwing assembly includes an engagement module disposed on the mounting plate and configured to be electrically connected with the mains electricity, and a snap-fit module disposed at the lamp body and configured to be electrically connected with the driving power supply, the snap-fit module is configured to be screwed into snap-fit with the engagement module in a screwing manner to form an electrical connection.

Further, the engagement module comprises a mounting seat disposed at an inner side wall of the mounting plate, and a conductive piece disposed in the mounting seat and configured to be electrically connected with the mains electricity, the mounting seat is provided with a slot; the snap-fit module includes a bracket disposed at the lamp body and a tongue mounted at the bracket and electrically connected to the driving power supply, the tongue is a conductive member, the tongue is connected with the slot in a screwing manner, and the tongue is in contact with the conductive piece.

Further, the lamp body is provided with a positioning hole, the mounting plate is provided with a positioning shaft configured for fitting and positioning the positioning hole such that the lamp body always rotates around the center axis of the lamp body during a screwing process.

Further, two ends of the conductive piece integrally extend with an elastic arm, respectively, a connecting opening is formed between the elastic arms of the two ends of the conductive piece and configured to cooperate with the tongue, the tongue is inserted into the connecting opening to be fixed, and the tongue is electrically connected with the elastic arms.

Further, the mounting seat is provided with cavity, and the conductive piece is mounted in the cavity, and the slot is in communication with the cavity.

Further, the engagement module further comprises a first fastener configured to fix the conductive piece into the mounting seat, the conductive piece is provided with a first through hole, the first fastener is fixedly connected to the mounting seat after passing through the first through hole.

Further, the first fastener is a screw.

Further, the bracket is provided with a receiving cavity, the tongue is mounted within the receiving cavity, and an end of the tongue protrudes outside the receiving cavity.

Further, the snap-fit module further comprises a second fastener configured to fix the tongue at the bracket, the tongue is provided with a second through hole, the lamp body is provided with a third through hole, and the second fastener is fixedly connected to the bracket after passing through the third through hole and the second through hole in sequence.

Further, the second fastener is a screw.

Further, the ceiling lamp further comprises a terminal configured to be electrically connected with the mains electricity, the terminal is arranged on the mounting plate, and the conductive piece is electrically connected with the terminal.

Further, the number of the engagement modules is at least two, and the number of the snap-fit modules is at least two.

Further, the number of the engagement modules is two, and the number of the snap-fit modules is two; one of the engagement modules is electrically connected with a neutral line of the mains electricity and one of the snap-fit modules, the other of the engagement modules is electrically connected with a neutral line of the driving power supply and the other of the snap-fit modules, and the snap-fit module is electrically connected to a live line of the driving power supply.

Further, the lamp body comprises a base and a lamp cover connected with the base, the snap-fit module is arranged on the base.

Further, the lamp cover is provided with a plurality of protrusions, and the base is mounted with a plurality of snap-stations, each of the plurality of snap-stations is provided with a buckle configured for cooperating with the one of the plurality of protrusions such that the base is fixedly connected with the lamp cover.

The beneficial effect of the ceiling lamp provided in the present application is that compared with the prior art, the ceiling lamp of the present application only needs to rotate the lamp body when the ceiling lamp needs to be mounted, so that the snap-fit module is fastened to the engagement module in a screwing manner to form an electrical connection with each other; thereby not only realizing the connection between the lamp body and the mounting plate, but also realizing the electrical connection, the installation is very convenient and fast, and has the advantages of good dust proof and insect proof. The lamp body and the mounting plate can be disassembled by reversely rotating the lamp body during disassembling, and the user can directly and accurately determine whether the snap-fit module and the engagement module have been mounted in place by means of turn on or off the lamp, the possibility of misassembly can be avoided, and safety and reliability are high.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
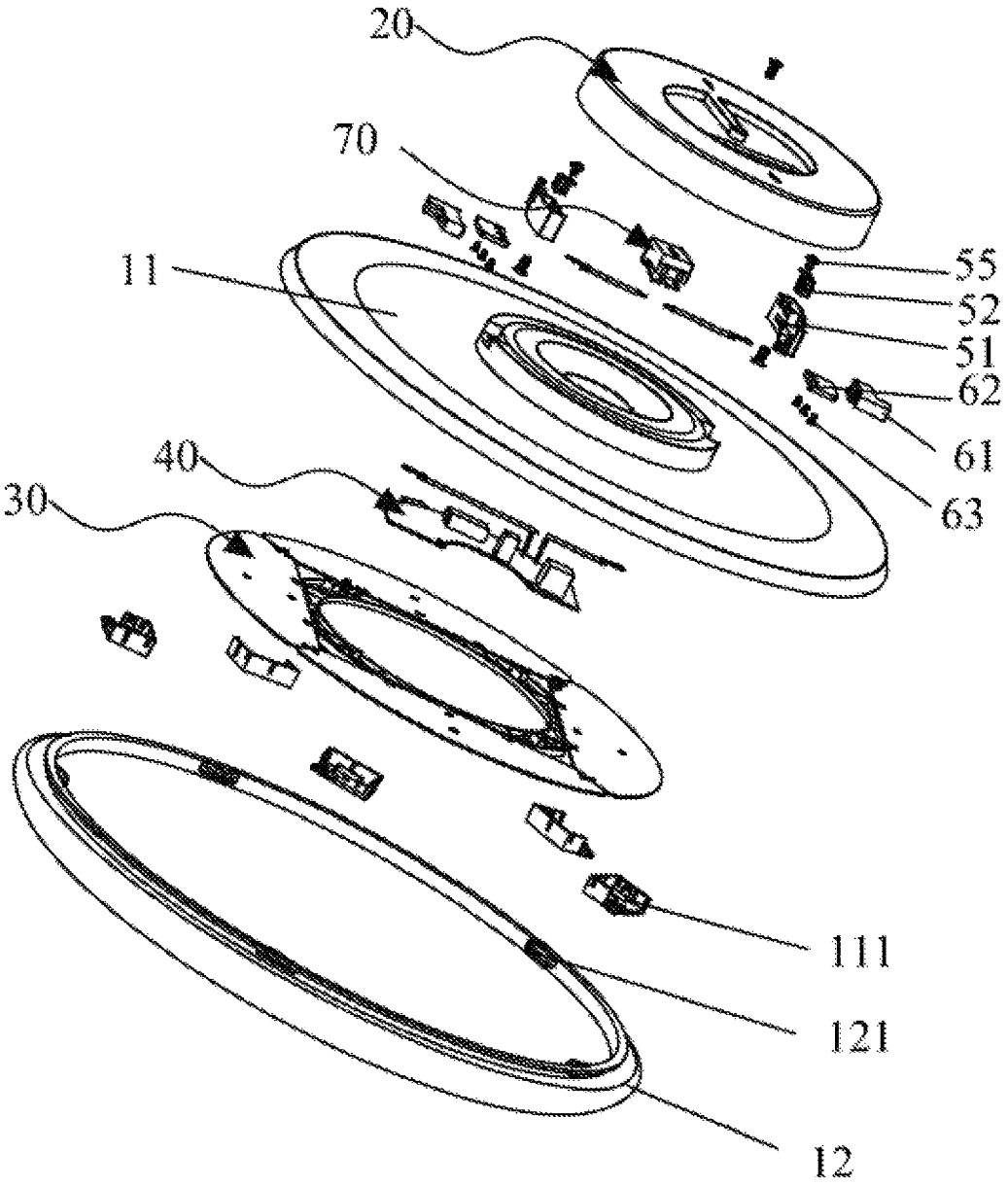
FIG. 1 is a schematic exploded view of a ceiling lamp provided by an embodiment of the present application.
Figure 2:
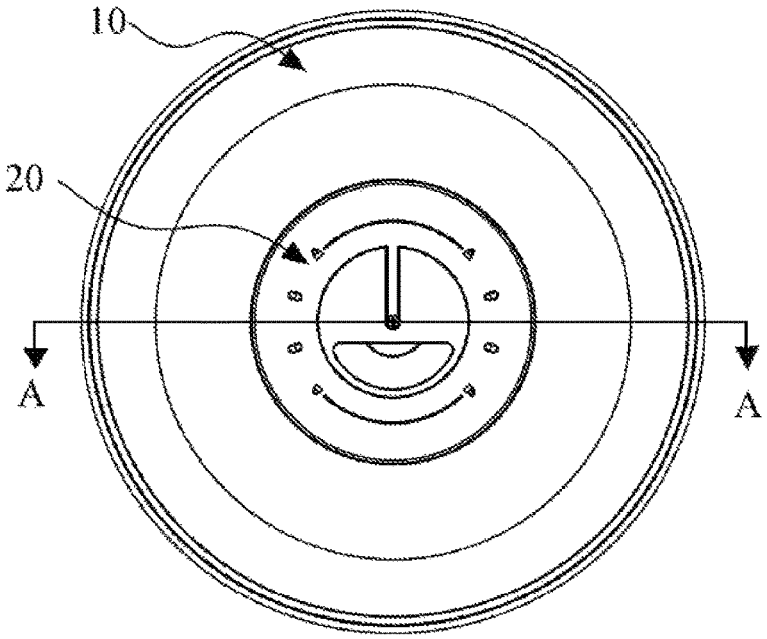
FIG. 2 is a top view of a ceiling lamp provided by an embodiment of the present application.

Wherein, the reference numerals are listed:

10—lamp body; 11—base; 111—snap-station; 12—lamp cover; 121—protrusion; 13—positioning hole; 20—mounting plate; 21—positioning shaft; 22—mounting board; 30—lighting module; 40—driving power supply; 50—engagement module; 51—mounting seat; 511—cavity; 52—conductive piece; 521—elastic arm; 522—connecting opening; 53—slot; 54—limiting block; 55—first fastener; 60—snap-fit module; 61—bracket; 62—tongue; 63—second fastener; 70—terminal.

DETAILED DESCRIPTION

In order to make the purpose, technical solutions, and beneficial effects of the present application clearer and more understandable, the present application will be further described in detail herein after with reference to the accompanying drawings and embodiments. It should be understood that the embodiments described herein are only intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component.

It should be understood that, "length", "width", "upper", "lower", "front", "back", "left" and "right", "vertical", "horizontal", "top", "bottom", "inside", "outside" and other terms indicating the orientation or positional relationship are based on orientation or positional relationship shown in the drawings, and are only for the purpose of facilitating the description of the application and simplifying the description, instead of indicating or implying that the indicated device or component must have a specific orientation and constructed and operated in a particular orientation, and therefore it cannot be construed as limitation of the application.

In addition, the terms "first" and "second" are for illustrative purposes only and should not be construed as indicating or implying a relative importance or implicitly indicating the quantity of technical features indicated. Therefore, a feature that defines "first" and "second" may expressly or implicitly include one or more of the features. In the description of the present application, "multiple" means two or more than two, unless otherwise specifically defined.

Please refer to FIG. 1 to FIG. 4, a ceiling lamp provided in the present application will be described. The ceiling lamp includes a lamp body 10, a mounting plate 20, a lighting module 30 and a driving power supply 40 electrically connected with the lighting module 30, the lighting module 30 and the driving power supply 40 are both disposed in the lamp body 10, the lamp body 10 is detachably fixed to the mounting plate 20 in a screwing manner; the ceiling lamp further comprises a screwing assembly configured to detachably fix the lamp body 10 to the mounting plate 20 in a screwing manner, the screwing assembly includes a engagement module 50 disposed on the mounting plate 20 and configured to be electrically connected with the mains electricity, and a snap-fit module 60 disposed at the lamp body 10 and configured to be electrically connected with the driving power supply 40, the snap-fit module 60 is configured to be connected with the engagement module 50 in a screwing manner to form an electrical connection.

Compared with the prior art, the beneficial effect of the ceiling lamp provided in the present application is that the ceiling lamp of the present application only needs to rotate the lamp body 10 when the ceiling lamp needs to be mounted, so that the snap-fit module 60 is fastened to the engagement module 50 in a screwing manner to form an electrical connection with each other; thereby not only realizing the connection between the lamp body 10 and the mounting plate 20, but also realizing the electrical connection, the installation is very convenient and fast, and has the advantages of good dust proof and insect proof. The lamp body 10 and the mounting plate 20 can be disassembled by reversely rotating the lamp body during disassembling, and the user can directly and accurately determine whether the snap-fit module 60 and the engagement module 50 have been mounted in place by means of turn on or off the lamp, the possibility of misassembly can be avoided, and safety and reliability are high.

Figure 3:
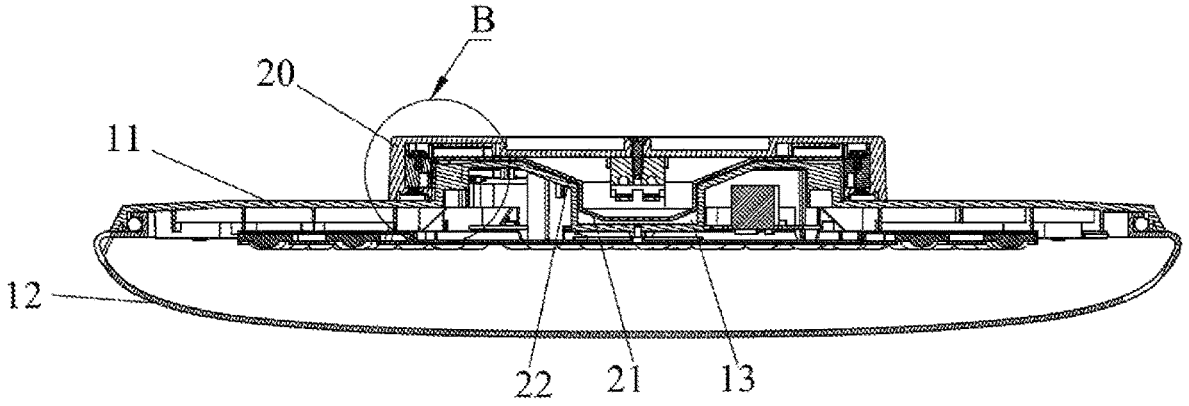
FIG. 3 is a cross-sectional structural view taken along line A-A of FIG. 2.
Figure 4:
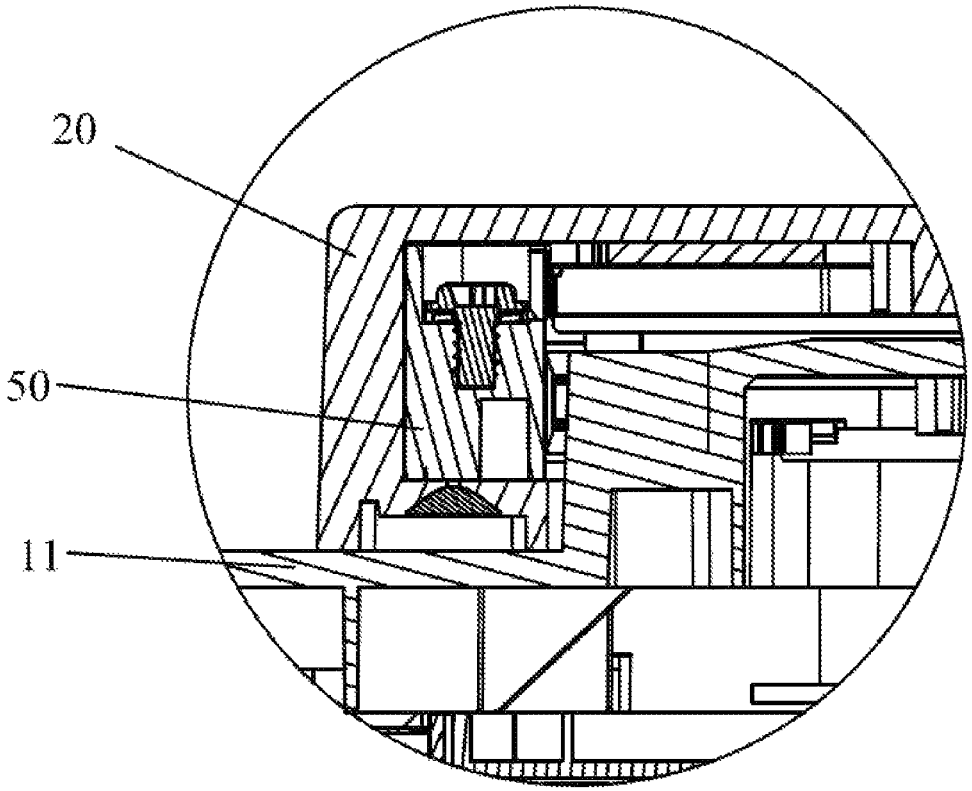
FIG. 4 is an enlarged schematic view at B of FIG. 3.
Figure 5:
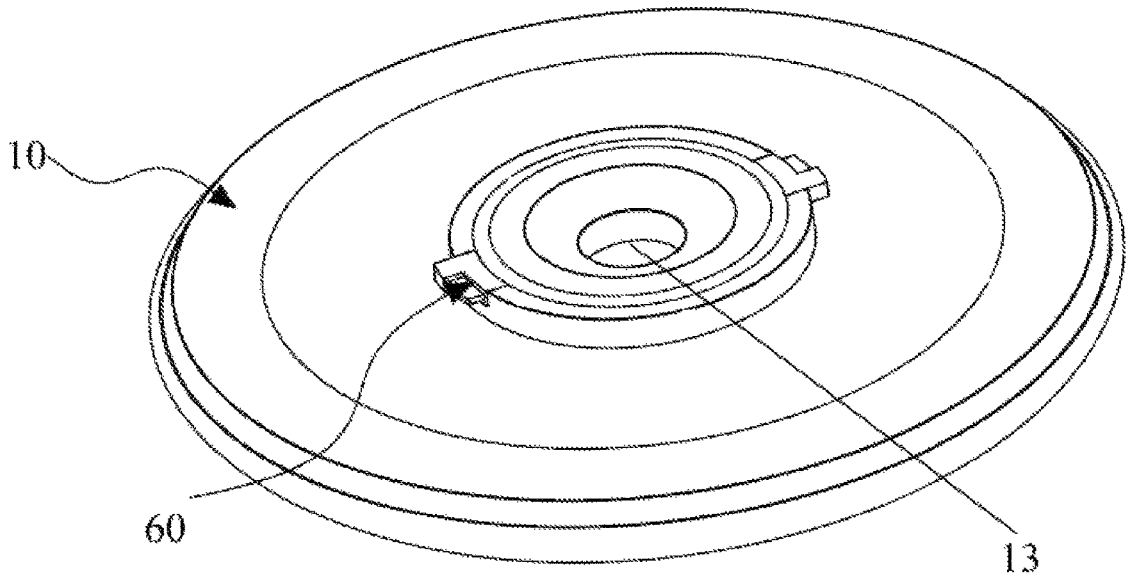
FIG. 5 is a schematic perspective structural view of a lamp body adopted in an embodiment of the present application.
Figure 7:
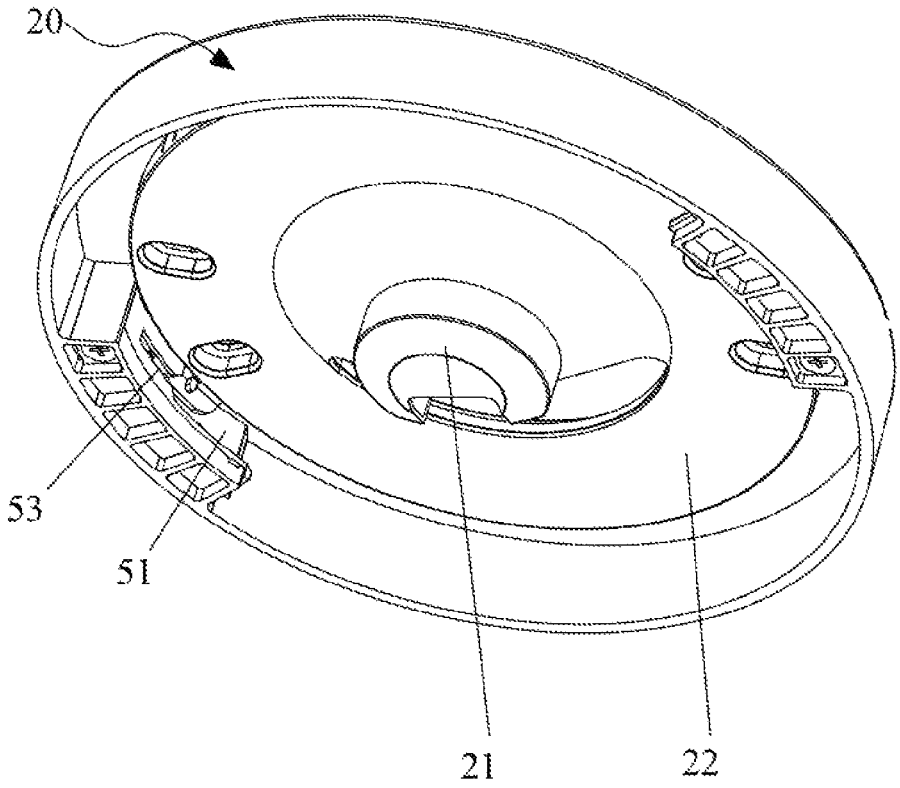
FIG. 7 is a schematic perspective structural view of a mounting plate adopted in an embodiment of the present application.

Further, please refer to FIG. 3, FIG. 5 and FIG. 7, as a specific embodiment of the ceiling lamp provided in the present application. The lamp body 10 is provided with a positioning hole 13, the mounting plate 20 is provided with a positioning shaft 21 configured for fitting and positioning the positioning hole 13 such that the lamp body 10 always rotates around the center axis of the lamp body 10 during a screwing process. When the lamp body 10 needs to be screwed onto the mounting plate 20, the positioning shaft 21 is firstly inset into the positioning hole 13 for positioning, which ensured that the lamp body 10 is always rotated around the center axis during installation to avoid deviation. Specifically, the mounting plate further includes a mounting board 22, and the positioning shaft 21 is disposed on the mounting board 22.

Further, please refer to FIG. 1, FIG. 5, FIG. 6, FIG. 8 and FIG. 9, as a specific embodiment of the ceiling lamp provided in the present application, the engagement module 50 includes a mounting seat 51 disposed at an inner side wall of the mounting plate 20, and a conductive piece 52 disposed in the mounting seat 51 and configured to be electrically connected with the mains electricity, the mounting seat 51 is provided with a slot 53, and the slot 53 is opposite to the conductive piece 52. The snap-fit module 60 includes a bracket 61 disposed at the lamp body 10 and a tongue 62 mounted at the bracket 61 and electrically connected to the driving power supply 40, the tongue 62 is a conductive member, the tongue 62 is connected with the slot 53 in a screwing manner, and the tongue 62 is in contact with the conductive piece 52 such that an end of the tongue 62 can be in contact with the conductive piece 52, when the tongue is properly connected into the slot 53, so that the lamp body 10 can be mounted while the electrical connection can be achieved, and the installation is convenient. Preferably, the conductive piece 52 is a copper piece, and the conductive member may be a metal piece. For example, the conductive member may be a copper piece or an iron piece or the like.

Figure 11:
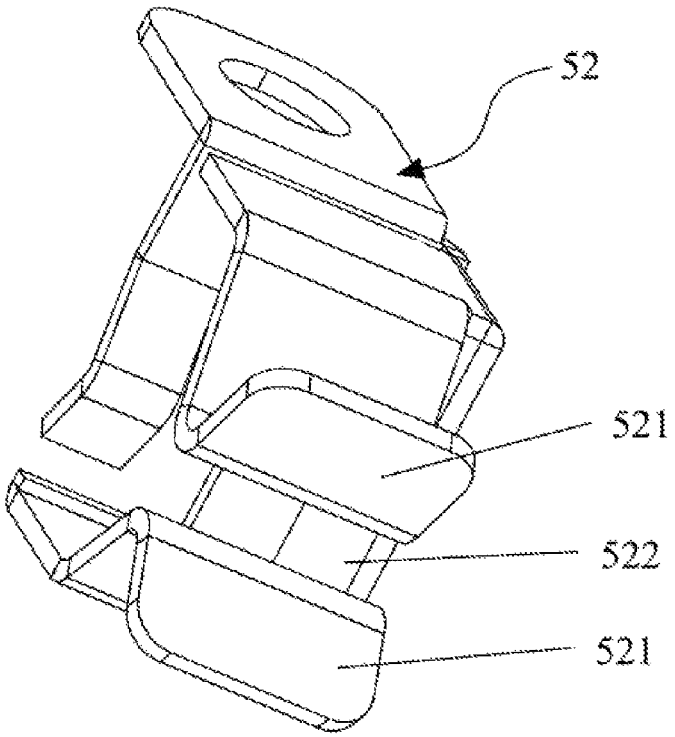
FIG. 11 is a schematic perspective structural view of a conductive piece used in an embodiment of the present application.

Further, please refer to FIG. 11, as an embodiment of the ceiling lamp provided in the present embodiment, two ends of the conductive piece 52 are integrally extended with elastic arms 521 respectively, and a connecting opening 522 is formed between the elastic arms 521 of the two ends of the conductive piece 52 and configured to fit the tongue 62, the tongue 62 is configured to be inserted into the connecting opening 522 such that the tongue 62 is electrically connected to the elastic arm 521. By connecting the tongue 62 into the connecting opening 522, the electrical connection can be made more stable and reliable to avoid loose. It should be noted that the manner of disposing the conductive piece 52 is not limited thereto. For example, in other preferred embodiments of the present application, the conductive piece 52 may also be a sheet structure or the conductive piece 52 is provided with a spring, the tongue being electrically connected to the conductive piece by the spring.

Further, please refer to FIG. 1, FIG. 8, FIG. 9 and FIG. 10, as a specific embodiment of the ceiling lamp provided in the present application, the mounting seat 51 is further provided with a limiting block 54, when the tongue 62 is fitted into the slot 53, the limiting block 54 abuts against the bracket 61 to prevent displacement. Specifically, the slot 53 is a long shaped slot.

Further, please refer to FIG. 1, FIG. 8, FIG. 9 and FIG. 10, as a specific embodiment of the ceiling lamp provided in the present application, the mounting seat 51 is provided with a cavity 511, and the conductive piece 52 is mounted in the cavity 511, the slot 53 is in communication with the cavity 511 such that when the tongue 62 is cooperated with the slot 53, an end of the tongue 62 can also protrude into the cavity 511 and in contact with the conductive piece 52.

Figure 8:
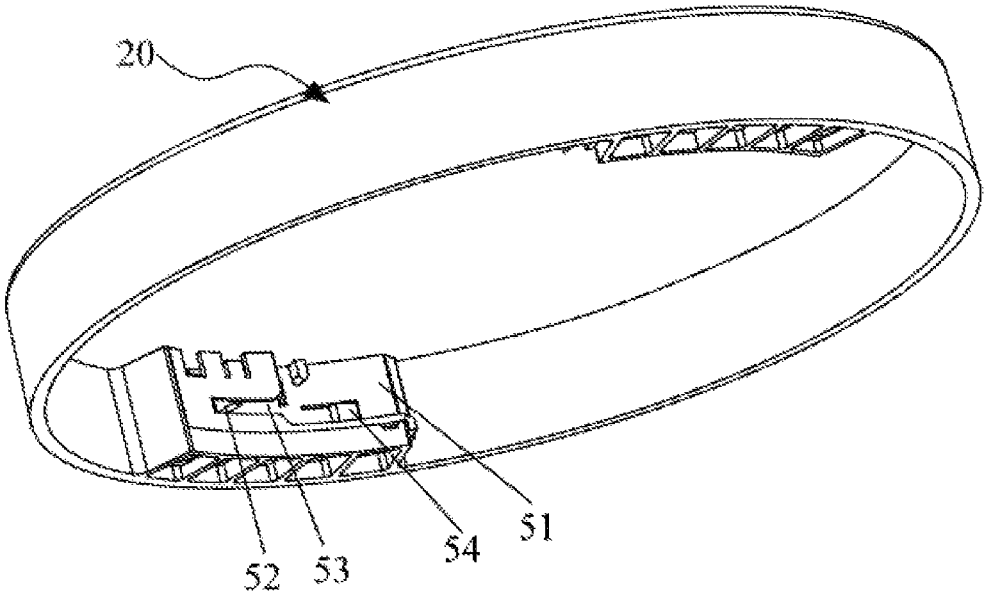
FIG. 8 is a schematic perspective structural view of a mounting plate adopted in an embodiment of the present application, wherein the mounting board is not shown.
Figure 9:
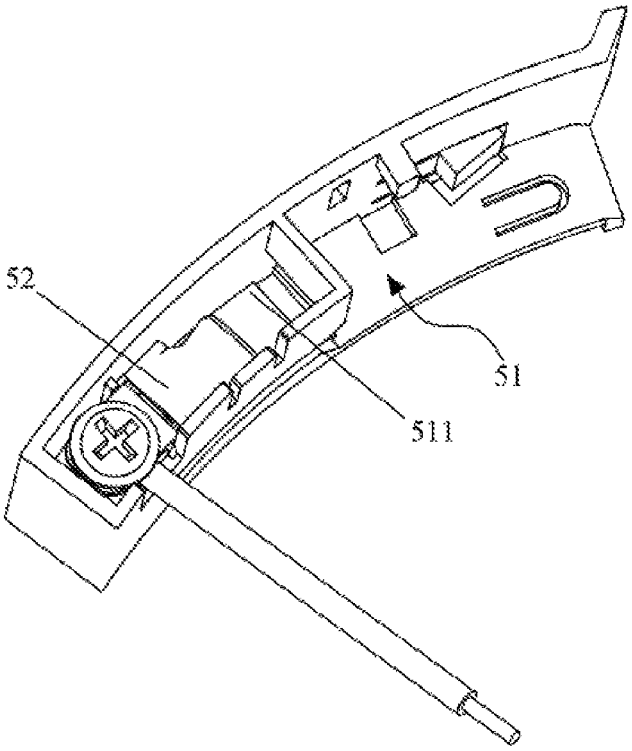
FIG. 9 is a schematic partial structural view of a engagement module adopted in the embodiment of the present application.
Figure 10:
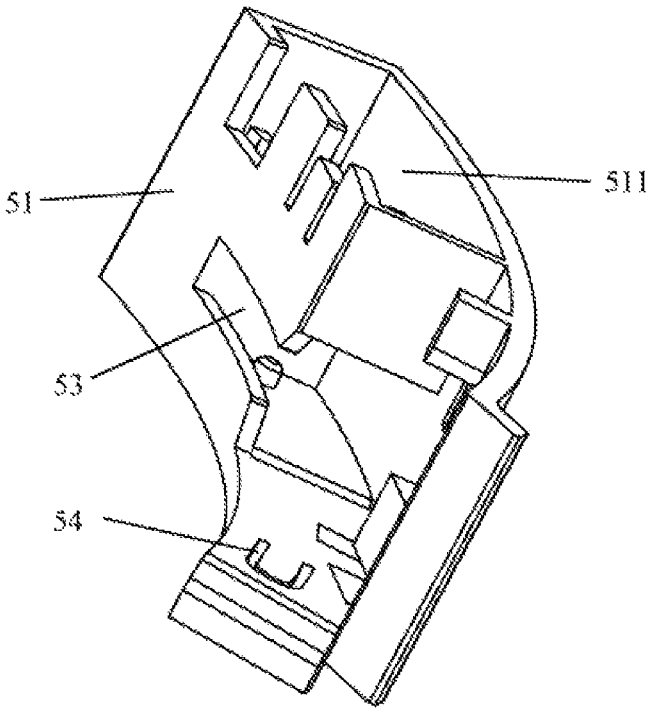
FIG. 10 is a schematic perspective structural view of a mounting seat adopted in an embodiment of the present application.

Further, please refer to FIG. 1, FIG. 8 and FIG. 9, as a specific embodiment of the ceiling lamp provided in the present application, the engagement module 50 further includes a first fastener 55 configured to fix the conductive piece 52 into the mounting seat 51, the conductive piece 52 is provided with a first through hole (not shown), the first fastener 55 is fixedly connected to the mounting seat 51 after passing through the first through hole. In this embodiment, the first fastener 55 is a screw.

Figure 6:
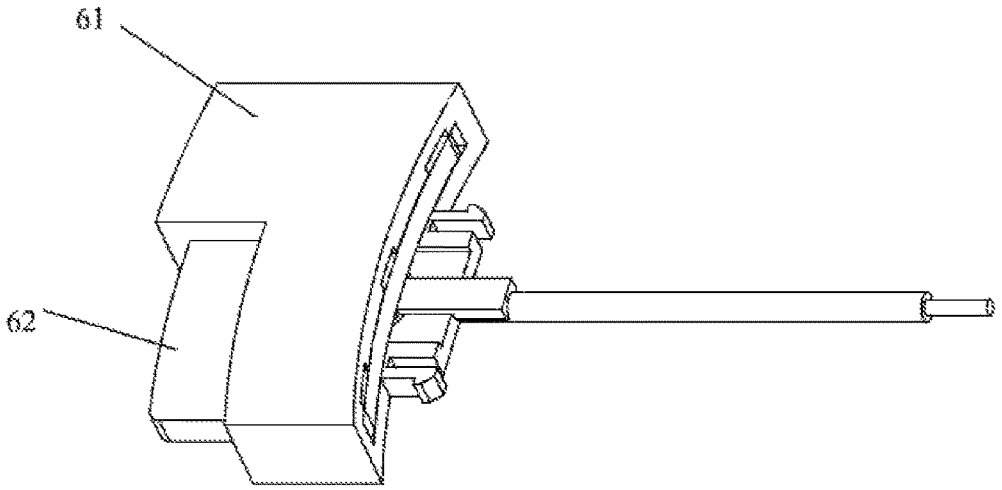
FIG. 6 is a schematic perspective structural view of a snap-fit module adopted in the embodiment of the present application.

Further, please refer to FIG. 1, FIG. 6 and FIG. 7, as a specific embodiment of the ceiling lamp provided in the present application, the bracket 61 is provided with a receiving cavity (not shown), and the tongue 62 is mounted within the receiving cavity, and an end of the tongue 62 protrudes outside the receiving cavity so that the tongue 62 can be fixed within the receiving cavity.

Further, please refer to FIG. 1, FIG. 6 and FIG. 7, as a specific embodiment of the ceiling lamp provided in the present application, the snap-fit module 60 further includes a second fastener 63 configured to fix the tongue 62 at the bracket 61, the tongue 62 is provided with a second through hole (not shown), the lamp body 10 is provided with a third through hole (not shown), and the second fastener 63 is fixedly connected to the bracket 61 after passing through the third through hole and the second through hole in sequence, such that the bracket in fixed at the lamp body 10. In this embodiment, the second fastener 63 is a screw.

Further, please refer to FIG. 1, FIG. 8 and FIG. 9, as a specific embodiment of the ceiling lamp provided in the present application, the ceiling lamp further includes a terminal 70 for electrically connecting to the mains electricity, the terminal 70 is disposed on the mounting plate 20, and the conductive piece 52 is electrically connected to the mains electricity through the terminal 70. When it is necessary to mount the ceiling lamp, it required to firstly fix the mounting plate 20 to the ceiling, and then electrically connect the terminal 70 to the mains electricity to realize electrical connection between the mains electricity and the conductive piece 52.

Further, please refer to FIG. 1 to FIG. 4, as a specific embodiment of the ceiling lamp provided in the present application, the number of the engagement modules 50 is at least two, and the number of the snap-fit modules 60 is at least two. For example, it may be two, three or four, etc., which is not limited here.

Further, please refer to FIG. 1 to FIG. 4, as a specific embodiment of the ceiling lamp provided in the present application, the number of the engagement modules 50 is two, and the number of the snap-fit modules 60 is two. One of the engagement modules 50 is electrically connected with a neutral line of the mains electricity and one of the snap-fit modules, the other of the engagement modules 50 is electrically connected with a neutral line of the driving power supply 40 and the other of the snap-fit modules 60, and the snap-fit module 60 is electrically connected to a live line of the driving power supply 40, so that the electrical connection of the ceiling lamp can be realized.

Further, please refer to FIG. 1 to FIG. 4, as a specific embodiment of the ceiling lamp provided in the present application, the lamp body 10 includes a base 11 and a lamp cover 12 connected to the base 11, the snap-fit module 60 is disposed on the base 11. Specifically, in the embodiment, the lamp cover 12 is provided with a plurality of protrusions 121, a plurality of snap-stations 111 are mounted on the base 11, and the plurality of snap-stations 111 are respectively provided with buckles (not shown), the protrusions 121 and the buckles are cooperated one by one to realize the connection and fixing of the base 11 and the lamp cover 12, and the assembly thereof is very simple and convenient, since the base 11 and the lamp cover 12 are integrally assembled before leaving the factory, therefore, good dust proof and insect proof effect can be achieved.

The working principle of the ceiling lamp of the present application is as follows:

When it is needed to mount the ceiling lamp, first, fixing the mounting plate 20 to the ceiling, and then electrically connecting the mains electricity to the terminal 70; and then, rotating the lamp body 10 such that the tongue 62 is screwed into the slot 53 and an end of the tongue 62 is in contact with the conductive piece 52, thereby realizing quick installation and electrical connection of the ceiling lamp; when it is needed to determine whether the lamp body 10 is mounted in place, it can be directly judged by means of turning on or off the lamp; When it is needed to be disassembly, only the lamp body 10 needs to be reversely rotated until the tongue 62 is separated from the slot 53. At this time, the lamp body 10 can be removed, thereby achieving quick disassembly of the lamp body 10.

The above are only the preferred embodiments of the present application, and are not intended to limit the present application. Any modifications, equivalent substitutions or improvements made within the spirit and principles of the present application are included in the scope of the present application.

What is claimed is:

1. A ceiling lamp, comprising: a lamp body, a mounting plate, a lighting module and a driving power supply electrically connected with the lighting module, wherein the lighting module and the driving power supply are both disposed in the lamp body, the lamp body is detachably screwed to the mounting plate; the ceiling lamp further comprises a screwing assembly configured to detachably fix the lamp body to the mounting plate in a screwing manner, wherein the screwing assembly comprises an engagement module disposed on the mounting plate and configured to be electrically connected with a mains electricity, and a snap-fit module disposed at the lamp body and configured to be electrically connected with the driving power supply, the snap-fit module is configured to be screwed into snap-fit with the engagement module in a screwing manner to form an electrical connection;

wherein the engagement module comprises a mounting seat disposed at an inner side wall of the mounting plate, and a conductive piece disposed in the mounting seat and configured to be electrically connected with the mains electricity, wherein the mounting seat is provided with a slot; the snap-fit module comprises a bracket disposed at the lamp body and a tongue mounted at the bracket and electrically connected to the driving power supply, wherein the tongue is a conductive member, the tongue is connected with the slot in a screwing manner, and the tongue is in contact with the conductive piece.

2. The ceiling lamp according to claim 1, wherein the lamp body is provided with a positioning hole, the mounting plate is provided with a positioning shaft configured for fitting and positioning the positioning hole such that the lamp body always rotates around the center axis of the lamp body during a screwing process.

3. The ceiling lamp according to claim 1, wherein two ends of the conductive piece integrally extend with an elastic arm, respectively, a connecting opening is formed between the elastic arms of the two ends of the conductive piece and configured to fit the tongue, the tongue is configured to be inserted into the connecting opening to be fixed, such that the tongue is electrically connected with the elastic arms.

4. The ceiling lamp according to claim 1, wherein the mounting seat is provided with cavity, and the conductive piece is mounted within the cavity, and the slot is in communication with the cavity.

5. The ceiling lamp according to claim 1, wherein the engagement module further comprises a first fastener configured to fix the conductive piece into the mounting seat, the conductive piece is provided with a first through hole, the first fastener is fixedly connected to the mounting seat after passing through the first through hole.

6. The ceiling lamp according to claim 5, wherein the first fastener is a screw.

7. The ceiling lamp according to claim 1, wherein the bracket is provided with a receiving cavity, the tongue is mounted within the receiving cavity, and an end of the tongue protrudes outside the receiving cavity.

8. The ceiling lamp according to claim 1, wherein the snap-fit module further comprises a second fastener configured to fix the tongue at the bracket, the tongue is provided with a second through hole, the lamp body is provided with a third through hole, and the second fastener is fixedly connected to the bracket after passing through the third through hole and the second through hole in sequence.

9. The ceiling lamp according to claim 8, wherein the second fastener is a screw.

10. The ceiling lamp according to claim 1, wherein the ceiling lamp further comprises a terminal configured to be electrically connected with the mains electricity, the terminal is arranged on the mounting plate, and the conductive piece is electrically connected with the terminal.

11. The ceiling lamp according to claim 1, wherein the number of the engagement modules is at least two, and the number of the snap-fit modules is at least two.

12. The ceiling lamp according to claim 11, wherein the number of the engagement modules is two, and the number of the snap-fit modules is two; one of the engagement modules is electrically connected with a neutral line of the mains electricity and one of the snap-fit modules, the other of the engagement modules is electrically connected with a neutral line of the driving power supply and the other of the snap-fit modules, and the snap-fit module is electrically connected to a live line of the driving power supply.

13. The ceiling lamp according to claim 1, wherein the lamp body comprises a base and a lamp cover connected with the base, the snap-fit module is arranged onto the base.

14. The ceiling lamp according to claim 13, wherein the lamp cover is provided with a plurality of protrusions, and the base is mounted with a plurality of snap-stations, each of the plurality of snap-stations is provided with a buckle configured for fitting the one of the plurality of protrusions such that the base is fixedly connected with the lamp cover.

* * * * *